US009030367B2

(12) United States Patent
Arvidsson et al.

(10) Patent No.: US 9,030,367 B2
(45) Date of Patent: May 12, 2015

(54) ANTENNA ARRAY ARRANGEMENT AND A MULTI BAND ANTENNA

(75) Inventors: Per-Anders Arvidsson, Solna (SE); Jesper Uddin, Stockholm (SE)

(73) Assignee: Intel Corporation, Santa Clara, CA (US)

( * ) Notice: Subject to any disclaimer, the term of this patent is extended or adjusted under 35 U.S.C. 154(b) by 226 days.

(21) Appl. No.: 13/454,984

(22) Filed: Apr. 24, 2012

(65) Prior Publication Data

US 2012/0280880 A1 Nov. 8, 2012

Related U.S. Application Data

(60) Provisional application No. 61/482,892, filed on May 5, 2011.

(51) Int. Cl.

| | |
|---|---|
| ***H01Q 21/00*** | (2006.01) |
| ***H01Q 1/24*** | (2006.01) |
| ***H01Q 5/00*** | (2006.01) |
| ***H01Q 15/16*** | (2006.01) |
| ***H01Q 19/10*** | (2006.01) |
| ***H01Q 21/08*** | (2006.01) |

(52) U.S. Cl.

CPC ..... *H01Q 1/246* (2013.01); *H01Q 5/002* (2013.01); *H01Q 5/0075* (2013.01); *H01Q 15/16* (2013.01); *H01Q 19/10* (2013.01); *H01Q 21/08* (2013.01)

(58) Field of Classification Search

USPC ..... 343/810, 824, 836, 700 MS

See application file for complete search history.

(56) References Cited

U.S. PATENT DOCUMENTS

| | | | | |
|---|---|---|---|---|
| 6,211,841 | B1 | 4/2001 | Smith et al. | |
| 6,937,191 | B2 * | 8/2005 | Puente Baliarda | 343/700 MS |
| 8,228,256 | B2 * | 7/2012 | Puente Baliarda et al. | 343/844 |
| 2002/0109633 | A1 * | 8/2002 | Ow et al. | 343/700 MS |
| 2003/0090431 | A1 * | 5/2003 | Gottl | 343/797 |
| 2003/0137456 | A1 * | 7/2003 | Sreenivas et al. | 343/700 MS |
| 2004/0108956 | A1 * | 6/2004 | Gottl et al. | 343/700 MS |
| 2005/0030247 | A1 | 2/2005 | Baliarda | |

FOREIGN PATENT DOCUMENTS

| | | |
|---|---|---|
| DE | 102007060083 | 6/2009 |
| EP | 1496569 A1 | 1/2005 |
| WO | WO 2007011295 A1 | 1/2007 |

OTHER PUBLICATIONS

International-type Search Report dated Oct. 31, 2011 from Application No. SE1150395-0.

* cited by examiner

*Primary Examiner* — Huedung Mancuso

(74) *Attorney, Agent, or Firm* — Schwegman Lundberg & Woessner, P.A.

(57) ABSTRACT

Antenna array arrangement for a multi band antenna, comprising a plurality of first dual band antenna elements adapted for transmitting/receiving in a lower antenna frequency band and in a higher antenna frequency band, a plurality of first single band antenna elements adapted for transmitting/receiving in the higher antenna frequency band, the first dual band antenna elements and the first single band antenna elements being arranged in a row, wherein at least two first single band antenna elements are arranged adjacent to each other. Furthermore, the invention also relates to a multi band antenna comprising at least one such antenna array arrangement.

27 Claims, 14 Drawing Sheets

ANTENNA ARRAY ARRANGEMENT AND A MULTI BAND ANTENNA

RELATED APPLICATION INFORMATION

The present application claims the benefit under 35 USC 119 (e) of provisional patent application Ser. No. 61/482,892, filed May 5, 2011, the disclosure of which is incorporated herein by reference in its entirety.

TECHNICAL FIELD

The present invention relates to an antenna array arrangement, and a multi band antenna comprising at least one such antenna array arrangement.

BACKGROUND OF THE INVENTION

Multi band antennas are antennas providing wireless signals in multiple radio frequency bands, i.e. two or more bands. They are commonly used and are well known in wireless communication systems, such as GSM, GPRS, EDGE, UMTS, LTE, and WiMax systems.

Such multi band antennas often comprises antenna arrays which are commonly used for transmitting and/or receiving wireless communication signals, such as Radio Frequency (RF) signals, in wireless communication systems. In this respect, the antenna arrays often comprises a plurality of antenna elements adapted for transmitting and/or receiving in different frequency bands.

FIG. 1 shows an example of a dual band antenna array according to prior art which comprises dual band and single band antenna elements arranged in a row as shown in FIG. 1. The antenna array arrangement in FIG. 1 comprises dual band antenna elements and single band antenna elements alternately arranged in a row in the order: dual band antenna element, single band antenna element, dual band antenna element, single band antenna element, and so on.

The dual band antenna elements are adapted for transmitting and/or receiving in a lower frequency band and in a higher frequency band while the single band antenna elements are adapted for transmitting and/or receiving in the higher frequency band only. The dual band and single band antenna elements are arranged such that the distance between the centres of two adjacent elements transmitting/receiving in the same frequency is often 0.5-1.0 times the wavelength for the centre frequency for the operational frequency band, and typically around 0.8 of that wavelength. That is, the distance between two adjacent single band antenna elements $d_x$ is often 0.8 times the wavelength for the centre frequency for the higher frequency band while the distance between two adjacent dual band antenna elements $d_y$ is often 0.8 times the wavelength for the centre frequency for the lower frequency band.

Although this type of antenna array arrangement has proved useful in modern wireless communication system, e.g. in base station antennas, they have some drawbacks.

One such drawback is that the prior art arrangements as shown in FIG. 1 require a certain spacing between the elements depending on the operating frequency in use as described above. Therefore, prior art arrangement is suitable for antenna configurations where the centre frequency for the higher frequency band is approximately two times or less than the centre frequency for the lower frequency band. If the centre frequency for the higher frequency band is more than two times the centre frequency for the lower frequency band the distance between the elements for the higher frequency bands becomes to large which may result in undesired grating lobes.

FIG. 2 shows another prior art antenna array arrangement where two different types of antenna elements are arranged in two different arrays. Antenna elements for a lower frequency band (790-960 MHz) are arranged in the left array and antenna elements for a higher frequency band (2.3-2.7 GHz) are arranged in the right array as shown in FIG. 2. Hence, the two arrays together form a dual band antenna array.

The drawback with the configuration in FIG. 2 is that the width of this antenna arrangement is substantial which leads to a bulky large design with considerable weight. Further, such arrangement also suffers from asymmetric horizontal/azimuth radiation as well as directional error.

Hence, there is a need for an improved antenna array arrangement for multi band antennas in the art.

SUMMARY OF THE INVENTION

Therefore, an object of the present invention is to provide an antenna array arrangement which fully or in part mitigates and/or solves the drawbacks of prior art antenna array arrangements. More specifically, the object of the present invention is to provide an antenna array arrangement which makes it possible to support dual band and single band antenna elements where there is a large spacing in the frequency range between a lower and a higher frequency and/or where the higher frequency is more than 2 times higher than the lower frequency.

Another object of the invention is to provide an antenna array arrangement which may be designed less bulky and taking up less space than prior art solutions. Yet another object of the invention is to provide an alternative antenna array arrangement compared to prior art.

According to one aspect of the invention, the mentioned objects are achieved with an antenna array arrangement for a multi band antenna, comprising a plurality of first dual band antenna elements adapted for transmitting/receiving in a lower antenna frequency band and in a higher antenna frequency band, a plurality of first single band antenna elements adapted for transmitting/receiving in the higher antenna frequency band, the first dual band antenna elements and the first single band antenna elements being arranged in a row, wherein at least two first single band antenna elements are arranged adjacent to each other.

Furthermore, the present invention also relates to a multi band antenna comprising at least one antenna array arrangement according to the invention.

The present invention provides an antenna array arrangement which allows smaller inter antenna element spacing, thereby avoiding undesirable grating lobes. This also means that the antenna design can be less bulky and smaller than prior art solutions, resulting in slim and cost effective antenna array designs with reduced weight. The present invention is especially suitable for antenna applications where there is a large spacing in the frequency range between the lower and higher frequencies.

An important aspect of the invention is that the inter antenna element spacing for both the lower antenna frequency band and the higher antenna frequency band is different, i.e. "non uniform spacing", over the antenna array in order to accommodate the different types of antenna elements in such a way that the effective element spacing (average spacing) over the array is such that undesired grating lobes are avoided in both bands.

Other implications of the invention include that electrical performance will be more consistent compared to prior art, e.g. undesired effects where horizontal beam peak of the two frequency bands are different and distorted azimuth radiation patterns.

Further advantageous and applications of the present invention can be found in the following detailed description of the present invention.

BRIEF DESCRIPTION OF THE DRAWINGS

The appended drawings are intended to clarify and explain different embodiments of the present invention in which.

DETAILED DESCRIPTION OF THE INVENTION

To achieve aforementioned and further objectives, the present invention relates to an antenna array arrangement, and preferably to an antenna array arrangement for multi band antennas adapted for wireless communication systems, such as such as GSM, GPRS, EDGE, UMTS, LTE, WiMax and other systems. An embodiment of such an antenna array arrangement is shown in FIG. 3.

The antenna arrangement according to the present invention comprises a plurality of dual band 101 and single band 102 antenna elements. The dual band antenna elements 101 are adapted for transmitting/receiving in two different frequency bands. i.e. in a lower antenna RF band and a higher antenna RF band, while the single band antenna elements 102 are adapted for transmitting/receiving in the higher of the two mentioned RF bands. The antenna elements of the present arrangement are arranged in a row/array as shown in FIG. 3, and at least two single band elements 102 are arranged adjacent to each other. However, more than two single band elements 102 may be arranged adjacent to each other.

Figure 1:
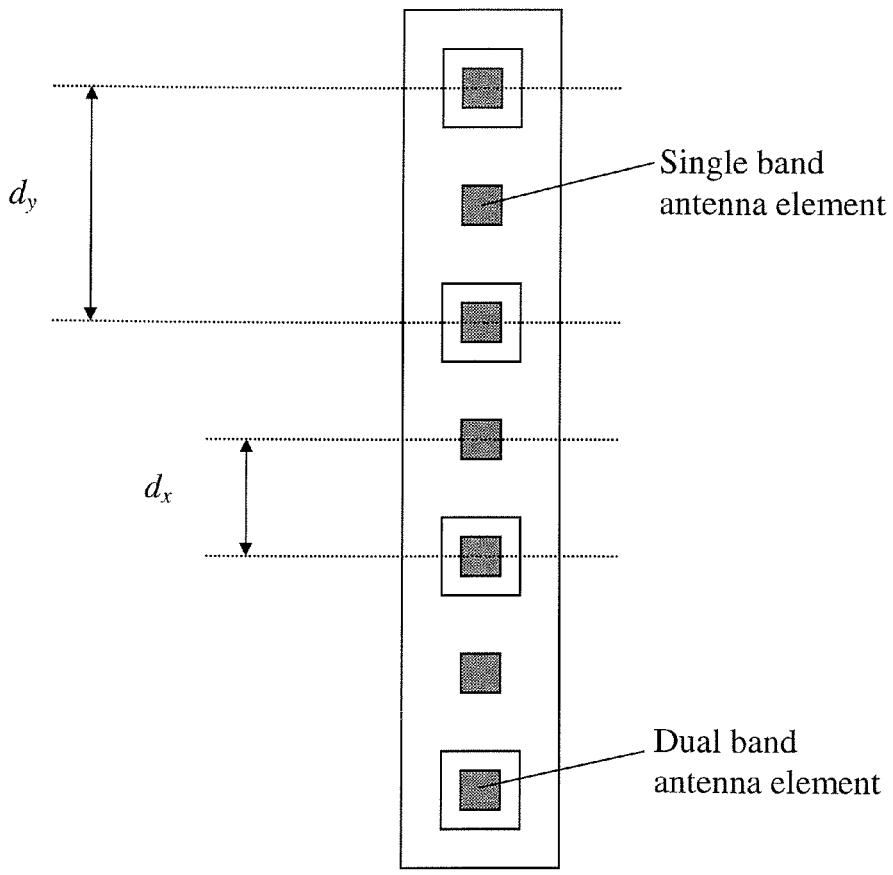
Fig. 1 (Prior Art)
FIG. 1 shows an antenna array arrangement according to prior art.
Figure 2:
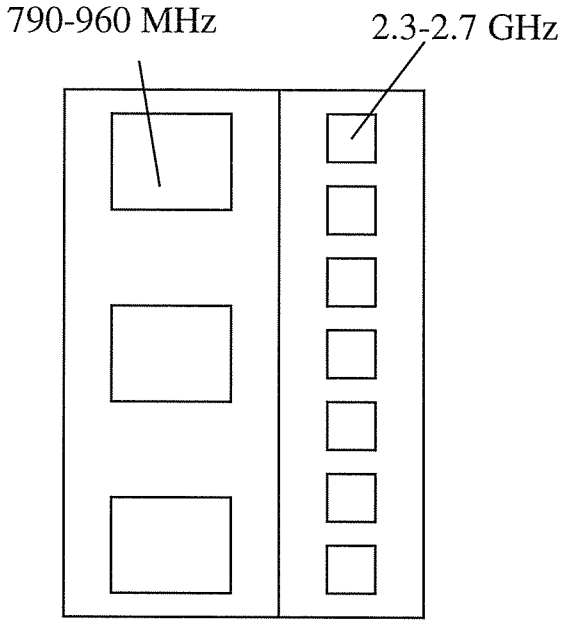
Fig. 2 (Prior Art)
FIG. 2 shows an antenna array arrangement according to another prior art.
Figure 3:
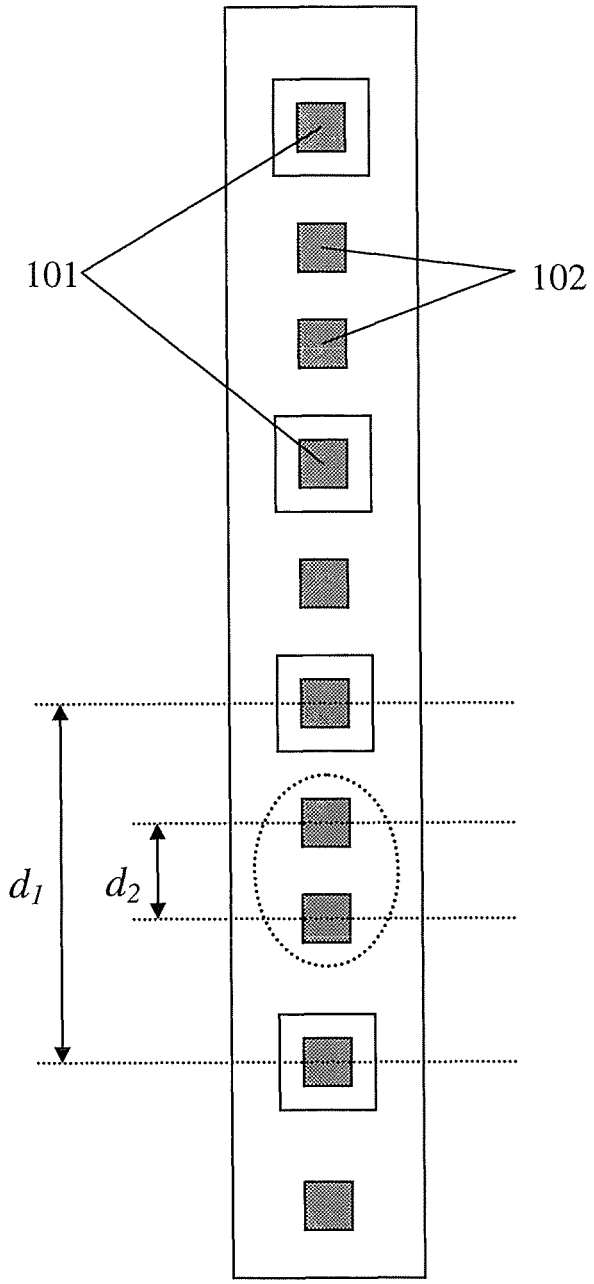
FIG. 3 shows an embodiment of an antenna array arrangement according to the present invention.

Two such single band antenna elements 102 are shown with a dotted circle in FIG. 3. Thus, it means that at least two single band elements 102 are arranged next to each other without any other antenna elements placed between the two single band antenna elements 102 in the row. Hence, the dual band 101 and single band 102 antenna elements are irregularly arranged in the row and not alternately (or evenly) arranged as the prior art arrangement shown in FIG. 1. Thereby, the effective inter element spacing can be kept small enough over the antenna array in order to avoid unwanted grating lobes. Also, with the present invention it is not necessary to have more than one row/array (or column) of antenna elements, thus wide antenna designs may be avoided which saves space.

According to an embodiment of the invention, the at least two single band antenna elements 102 are arranged between two dual band antenna elements 101, which is also shown in FIG. 3. Preferably, the distance $d_2$ between the centres of the at least two single band antenna elements 102 is more than half the wavelength for the centre frequency of the higher antenna frequency band, and preferably between 0.6-0.9 times the wavelength for the centre frequency of the higher antenna frequency band.

Also, according to yet another embodiment, the distance $d_2$ between the centres of the at least two first single band antenna elements 102 is 0.6-0.8 times the wavelength for the centre frequency of the higher antenna frequency band and the distance between first dual band antenna elements 101 and first single band antenna elements 102 is 0.8-1.0 times the wavelength for the centre frequency of the higher antenna frequency band.

Figure 4:
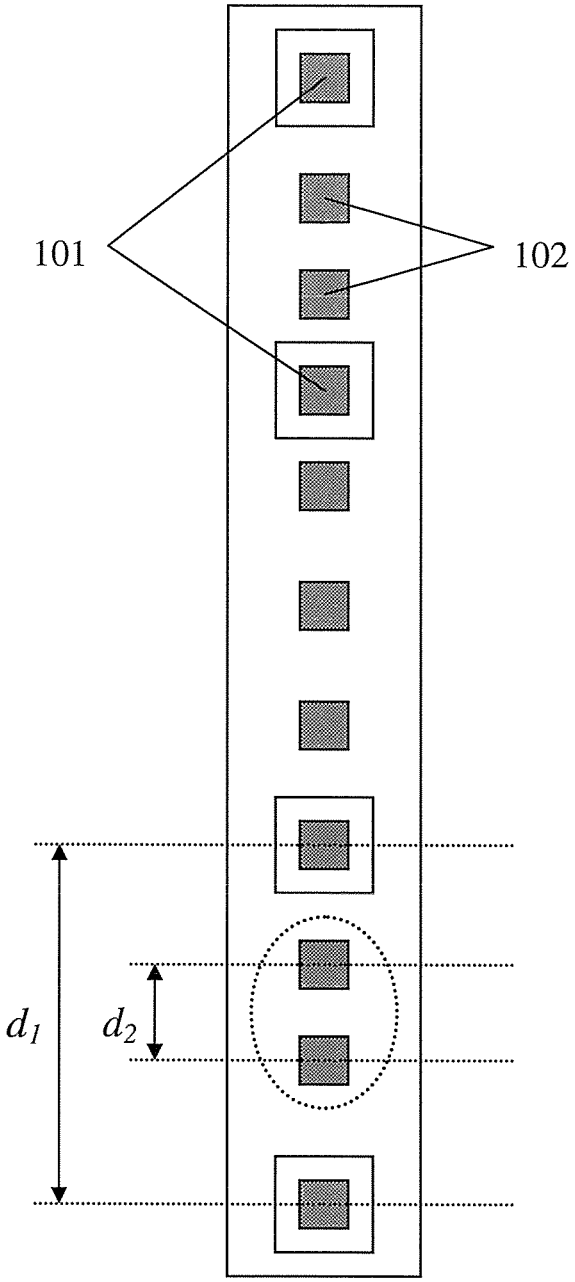
FIG. 4 shows another embodiment of an antenna array arrangement according to the present invention.
Figure 5:
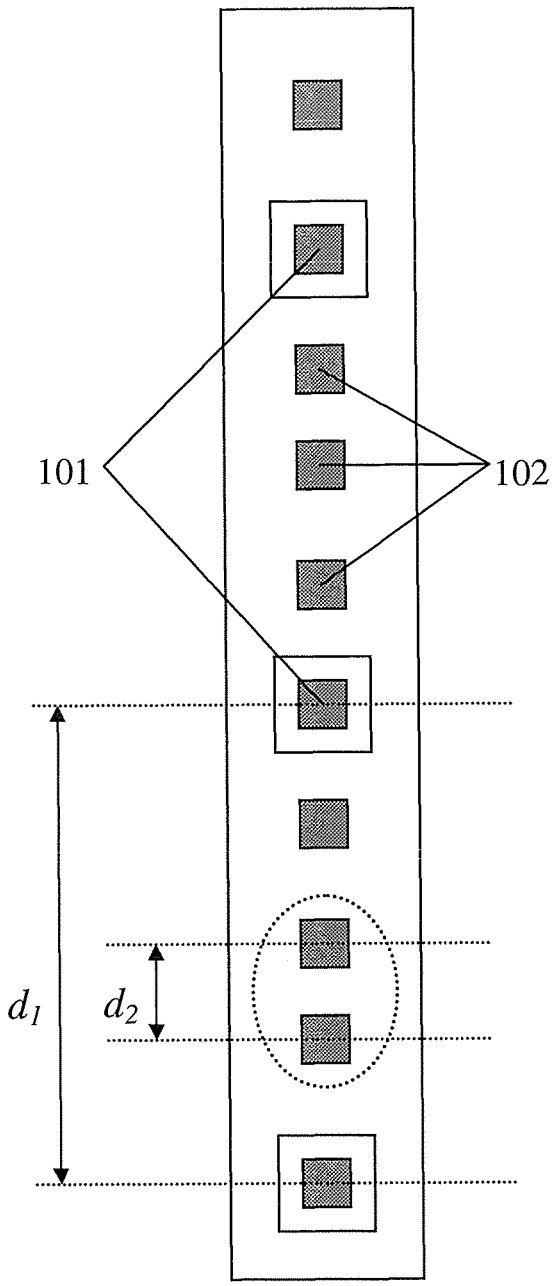
FIG. 5 shows another embodiment of an antenna array arrangement according to the present invention.
Figure 6:
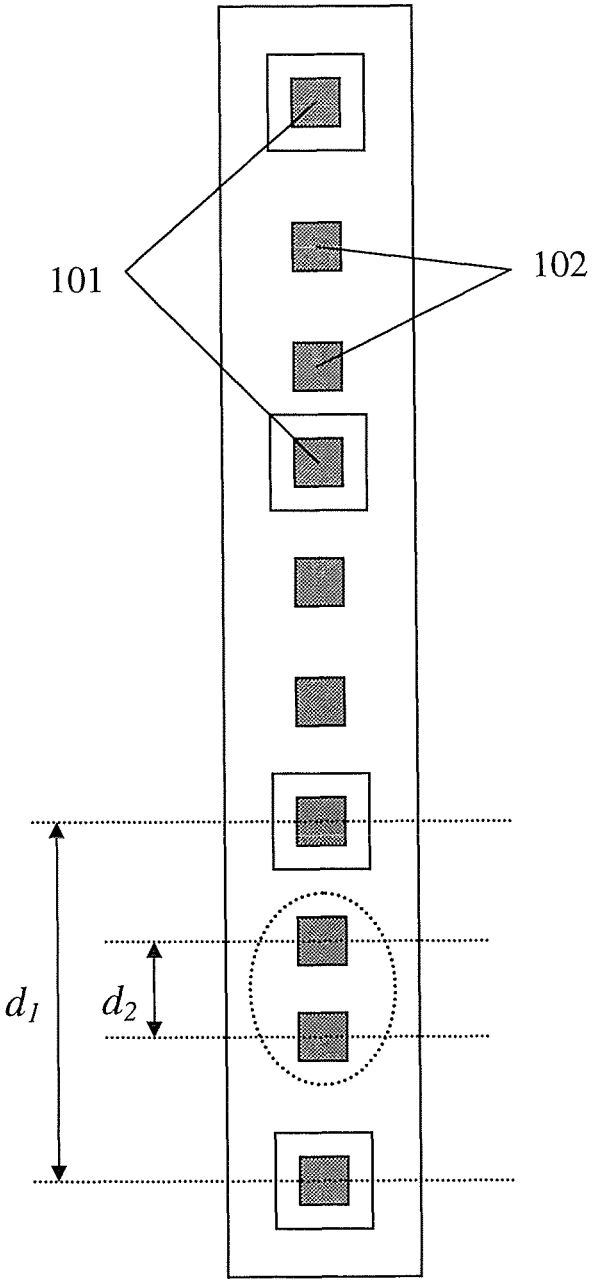
FIG. 6 shows another embodiment of an antenna array arrangement according to the present invention.

According to an embodiment, the centre frequency for the higher frequency band is more than 2 times higher than the centre frequency band for the lower frequency band. The centre frequencies for the first type dual band 101 and first type single band 102 antenna elements, i.e. the lower and higher frequency bands, are according to further embodiments of the invention within the interval of: 790 to 960 MHz and 2.3 to 2.7 GHz; 698 to 894 MHz and 2.3 to 2.7 GHz; 698 to 894 MHz and 3.6 to 3.8 GHz; or 790 to 960 MHz and 3.6 to 3.8 GHz, respectively. Hence, the ratio is around 2.86, 3.14, 4.65 and 4.22 for these embodiments. The number of single band antenna elements arranged between dual band antenna elements may be more than two, e.g. three or four. FIGS. 4-6 shows further embodiments of the present invention with different inter antenna element spacing.

Figure 7:
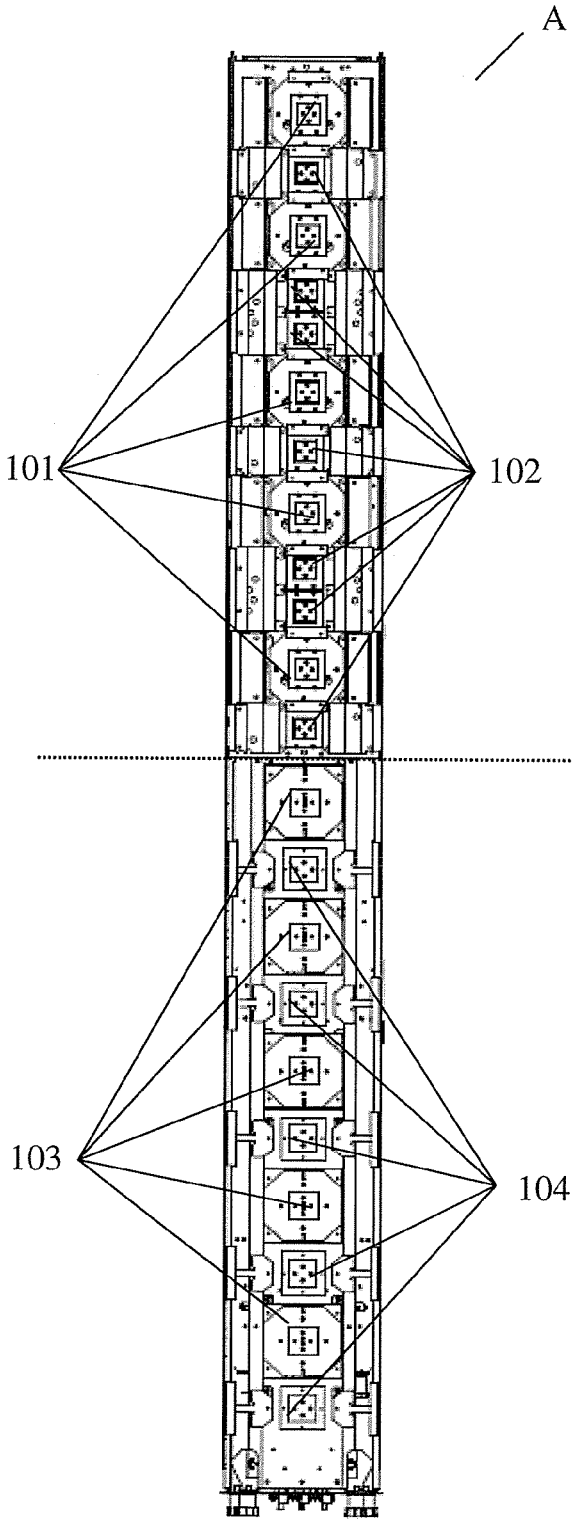
FIG. 7 shows, in view from above, an embodiment of a multi band antenna according to the invention without a housing.
Figure 8:
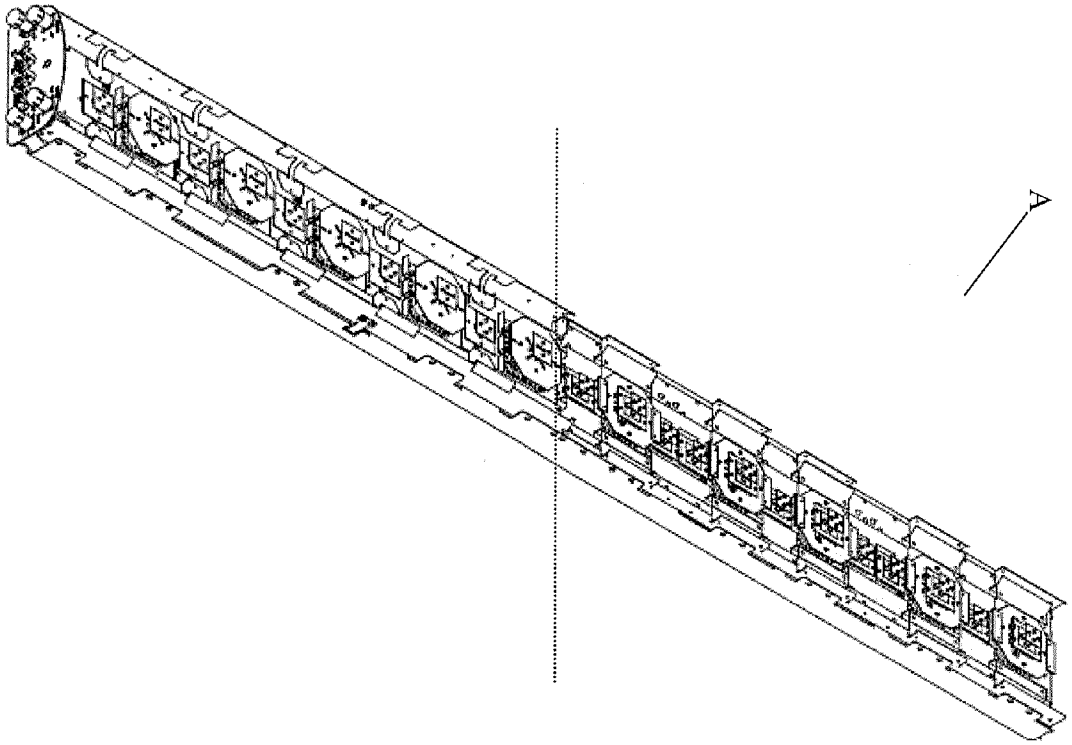
FIG. 8 shows the embodiment of the multi band antenna in FIG. 7 in perspective view.

FIG. 7 shows an embodiment of a triple band base station antenna according to the present invention, and FIG. 8 shows the embodiment of FIG. 7 in a perspective view. As shown in these figures, the triple band antenna comprises two antenna parts having different antenna array element configuration, but together forming a single row of antenna elements. The dotted lines in FIGS. 7 and 8 show where the two antenna parts are electrically, and in this case also mechanically coupled.

This arrangement further comprises a plurality of second type of dual band antenna elements 103 and second type of single band 104 antenna elements which according to an embodiment are alternately arranged with respect to each other so that every second antenna element is a second dual band 103 or a second single band 104 element as shown in the lower antenna part in FIGS. 7 and 8. The second type dual band antenna elements 103 are adapted for transmitting/receiving in two different frequency bands. i.e. in the lower RF band (the same lower frequency band as for the first type if dual band antenna elements) and in an intermediate RF band, while the second type single band antenna elements 104 are adapted for transmitting/receiving in the intermediate frequency band.

The centre frequencies for the first type dual band 101 and first type single band 102 antenna elements, i.e. the lower and higher frequency bands, are e.g. within the interval of 790 to 960 MHz, and 2.3 to 2.7 GHz, respectively; while the centre frequencies for the second dual band 103 and second single band 104 antenna elements, i.e. the lower and the intermediate frequency bands, are within the interval of 790 to 960 MHz, and 1710 to 2170 MHz, respectively, so that a triple band antenna is formed. The antenna elements used may e.g. be patch antenna elements or dipoles, or any other suitable antenna construction.

Since the embodiment in FIGS. 7 and 8 is formed by two antenna parts having two different types of dual and single band elements, the reflector structure for such as triple band antenna will also be described in the following.

The reflector according to this embodiment comprises a first reflector assembly 1 and at least one second reflector assembly 2. The first reflector assembly 1 has a first reflector structure adapted for the lower antenna frequency band and at least the higher antenna frequency band, and the second reflector assembly 2 has a second reflector structure adapted for the lower antenna frequency band and at least the intermediate antenna frequency band.

The first 1 and second reflector 2 assemblies are electrically coupled to each other so that they together form a common reflector structure R adapted for the lower, intermediate and higher antenna frequency bands. Thus, the first 1 and second 2 reflector assemblies have a reflector structure adapted for at least one common antenna frequency band, in this case the lower antenna frequency band.

It should therefore be realised that the common reflector R may comprise more than two reflector assemblies. However, two or more reflector assemblies making up the common reflector R should each have a reflector structure adapted for at least one common antenna frequency band $f_C$.

Such a reflector has good radiation control for multiband antennas. This is especially the case for multi band antennas transmitting in multiple antenna frequency bands where the frequency bands are considerably spaced apart in the frequency range. Another advantage with such a common reflector R is that a large and/or complex reflector structure for multiple bands can be assembled with two or more reflector assembly parts having simple structure, thereby simplify and reducing cost when manufacturing such reflectors, and make transportation easier of these reflectors. This also implies that a high degree of freedom is at disposal for the antenna designer when designing reflectors for multiband antenna since the designer can combine different reflector structures to obtain a common reflector structure.

Moreover, a reflector structure adapted for a specific antenna frequency band should in this disclosure mean that the reflector structure is so arranged that a transmit antenna having such a reflector fulfils one or more of the requirements of different reflector parameters known in the art. The reflector parameters are often specified for different applications and may concern horizontal beam width, front to back lobe ratio, cross polar discrimination, port to port tracking, etc. To achieve this, the reflector structure has a specific shape and may comprise shielding walls, baffles, corrugations and/or current traps, etc. for controlling radiation of the antenna. Typically, such parameters may be specified as: horizontal beam width (halfpower/−3 dB) 65 or 90 degrees; front to back lobe ratio 25-30 dB (+/−30 deg sector); cross polar discrimination 10-15 dB (worst case in +/−60 deg sector); port to port tracking<2 dB (worst case in +/−60 deg sector).

Figure 9:
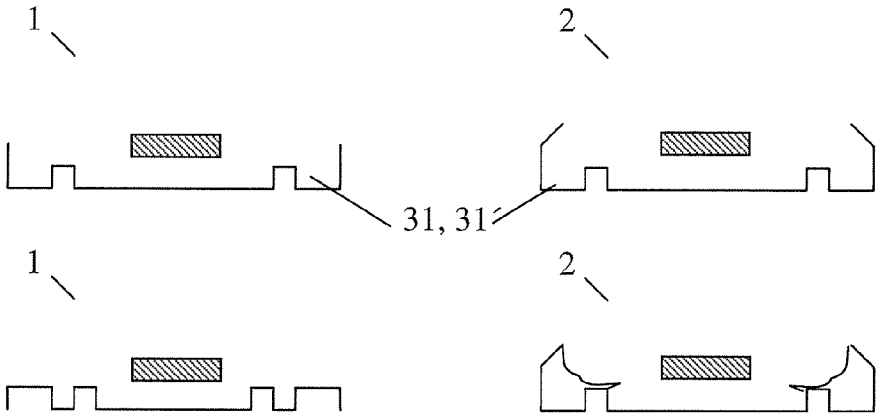
FIG. 9 shows, in cross section, first and second reflector assemblies of a common reflector structure.

FIG. 9 shows, in cross section, first and second reflector assemblies of a common reflector structure R. The first reflector assembly 1 is shown on the left hand side and the second reflector assembly 2 on the left hand side in FIG. 9. The dashed rectangles illustrate different antenna elements, and the upper and lower drawings in FIG. 9 represent cross sections at different antenna elements arranged for emitting in different frequency bands. It should be noted that the first 1 and second 2 reflector assemblies has different shapes, and from FIG. 9 it is evident that they have different cross-section shapes. The different shapes are due to the fact that the first 1 and second 2 reflector assemblies are adapted for at least one different antenna frequency band.

Figure 10:
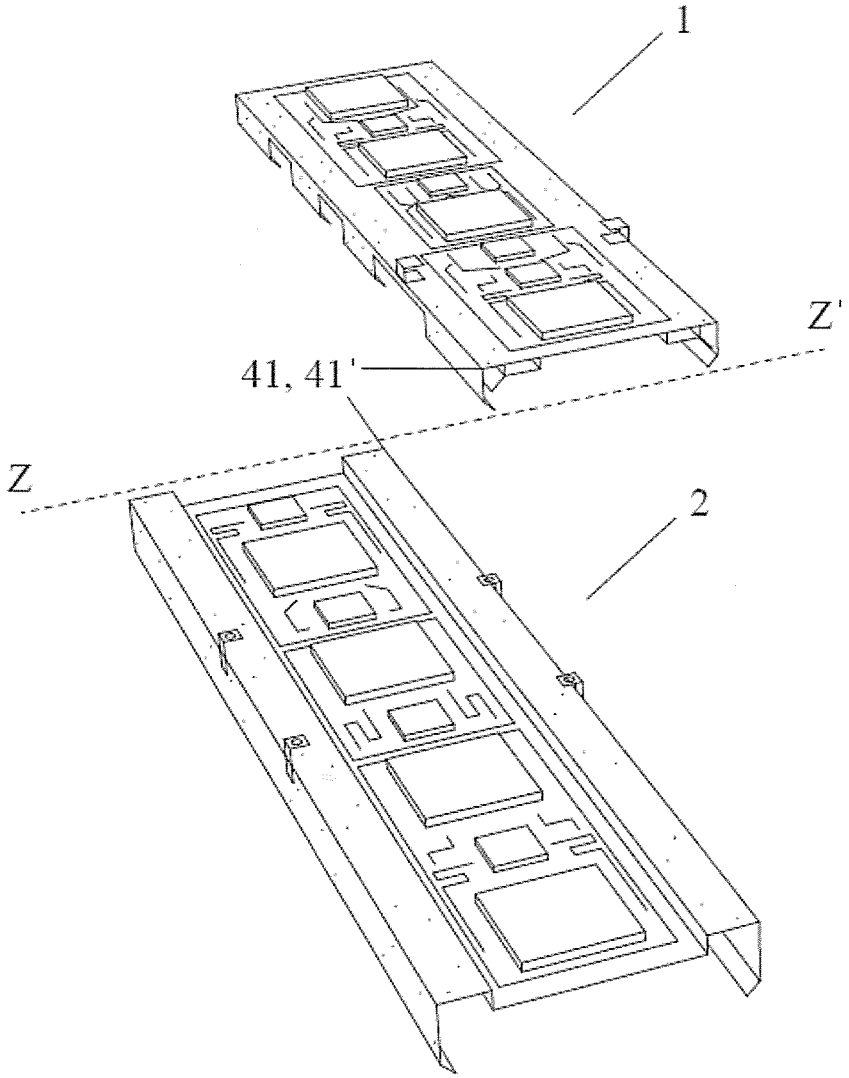
FIG. 10 shows a backside perspective view of the first and second reflector assemblies when not connected to each other.

FIG. 10 shows a partially exploding view of the back side of the first 1 and second 2 reflector assemblies with PCB etchings and antenna elements. On each reflector assembly 1, 2, the antenna elements corresponding with the bigger shielding cage is operating in two frequency bands simultaneously, i.e. the lower and higher frequency bands for the first reflector 1 and the lower and intermediate frequency bands for the second reflector 2. The antenna elements corresponding to the smaller shielding cage are operating in one frequency band each: the higher frequency band for the first reflector 1 and the intermediate frequency band for the second reflector 2. Corresponding ends 41, 41' of the first 1 and second 2 reflector assemblies, which are connected in use, is also shown in FIG. 10.

The first 1 and second 2 reflector assemblies are electrically coupled so that they together form a common reflector structure R so arranged that the common reflector structure R fulfils one or more of the above mentioned reflector parameters, e.g. provides a specific beam width characteristic or front to back lobe ratio.

The electrical coupling may be an indirect coupling, such as a capacitive coupling, or a direct coupling. A capacitive coupling can be made by using a non-conductive adhesive, e.g. tape or glue, between the first and second reflector assemblies. A direct electrical coupling can be achieved by spot welding, anodizing and bolting or by using a conductive adhesive.

The common reflector R is in this case adapted for triple band antennas, and as mentioned the centre frequencies (e.g. the carrier frequencies) for the three bands are within the interval of 790 to 960 MHz for the lower antenna frequency band, the interval of 1710 to 2170 MHz for the intermediate antenna frequency band, and the interval of 2.3 to 2.7 GHz for the higher antenna frequency band, respectively.

Moreover, base station antennas in mentioned wireless communication systems are often exposed to harsh environmental conditions, such as rain, snow, ice, heavy winds, etc. Hence, an important aspect when designing such antennas is the mechanical stiffness and robustness to withstand such conditions. The robustness of such antennas depends more or less on the reflector design since the reflector is an important and integral part of the antenna construction. Accordingly, the first 1 and second 2 reflector assemblies are furthermore mechanically connected to each other according to another embodiment.

Figure 11:
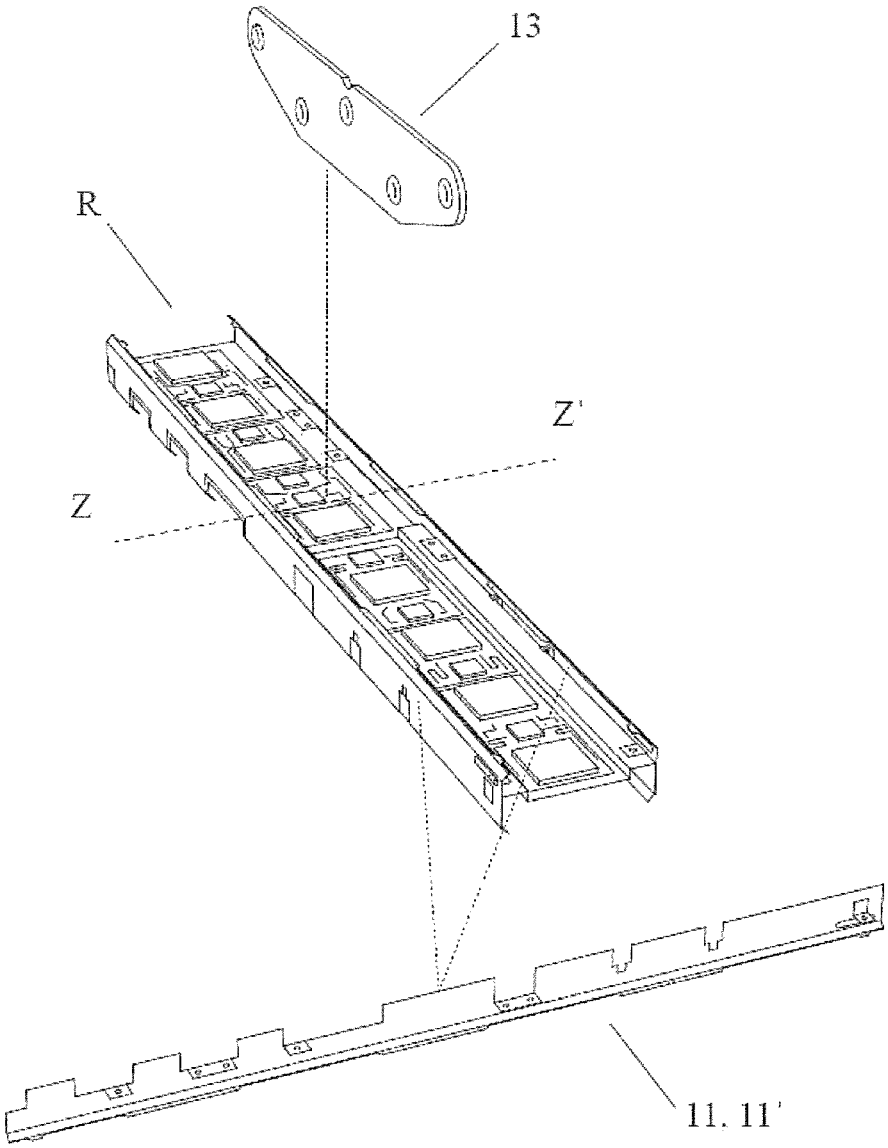
FIG. 11 shows a backside perspective view of an embodiment of an assembled common reflector structure/assembly.

FIG. 11 shows a backside perspective view of such a reflector R. The first 1 and second 2 reflector assemblies is electrically and mechanically connected to each other by means of a pair of support brackets 11, 11' and a connecting plate 13. It should be noted that the first 1 and second 2 reflector assemblies are connected to each other end-to-end in this embodiment, i.e. one end 41 of the first 1 reflector assembly is connected to a corresponding end 41' of the second 2 reflector assembly.

Each of the support brackets 11, 11' are mechanically connected to and extends along each opposite side of the first 1 and second 2 reflector assemblies, respectively. The first 1 and second 2 reflector assemblies has in this embodiment an elongated flat shape and the same width.

Preferably, the first 1 and second 2 reflector assemblies are U-shaped in cross-section as shown in the figures. With this reflector design, each support bracket 11, 11' is L-shaped to fit the U-shape of the first 1 and second 2 reflector assemblies, thereby improving the stiffness and robustness of the reflector R construction further and also saving space. This embodiment is shown in FIG. 11.

Figure 12:
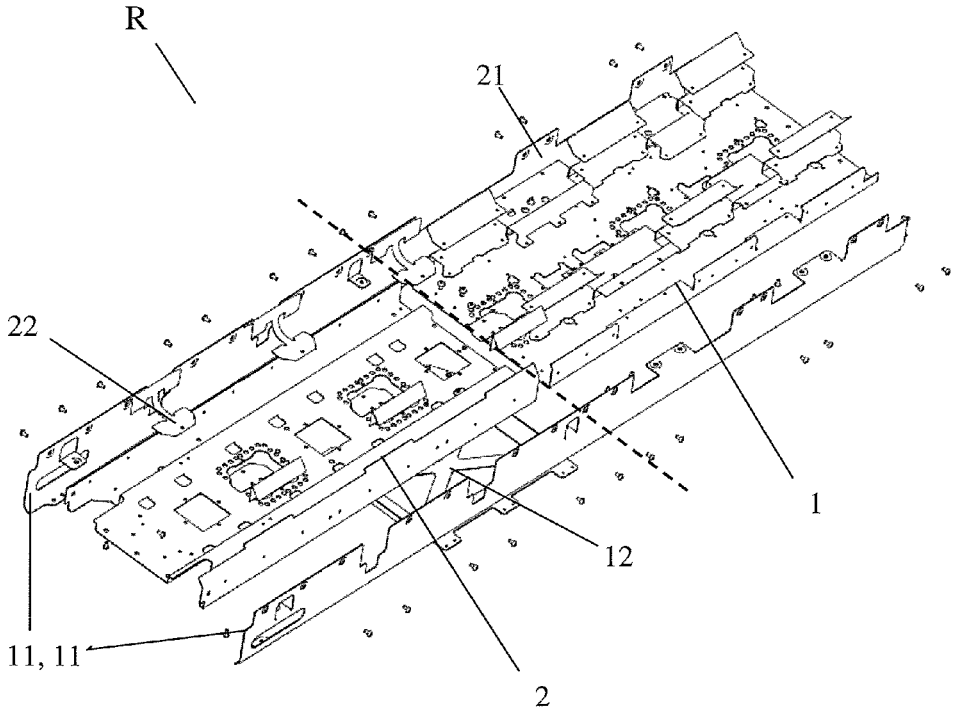
FIG. 12 shows a front side exploding view of a common reflector structure.

FIG. 12 shows a front side exploding view of a common reflector structure for use with a multi band antenna according to the invention.

To further improve electrical and/or mechanical coupling/connection between the first 1 and second reflector assemblies 2, on or more connector plates 13 may be provided to connect the two assemblies 1, 2. The connector plates 13 may be arranged on the front side and/or on the backside of the common reflector R, and extend over and being attached to both the first 1 and second 2 reflector assemblies so as to provide a robust reflector structure R.

Preferably, the first 1 and second 2 reflector assembly parts are made of aluminium, e.g. by folding aluminium sheet metal or by extrusion. The different reflector parts, such as the first 1 and second 2 reflector assemblies, support brackets 11, 11', connector plates 13, and connecting elements 12 may be mechanically connected to each other by e.g. screwing, riveting, bolting, welding, etc, which provide a direct electrical coupling.

To yet further improve the mechanical robustness and stiffness of the reflector R, one or more connecting elements 12 may be provided for electrically and mechanically connecting the support brackets 11, 11'. The connecting elements are preferably arranged on the back side of the reflector so as not to influence the radiation of the antenna elements by being arranged in front of the antenna elements.

Figure 13:
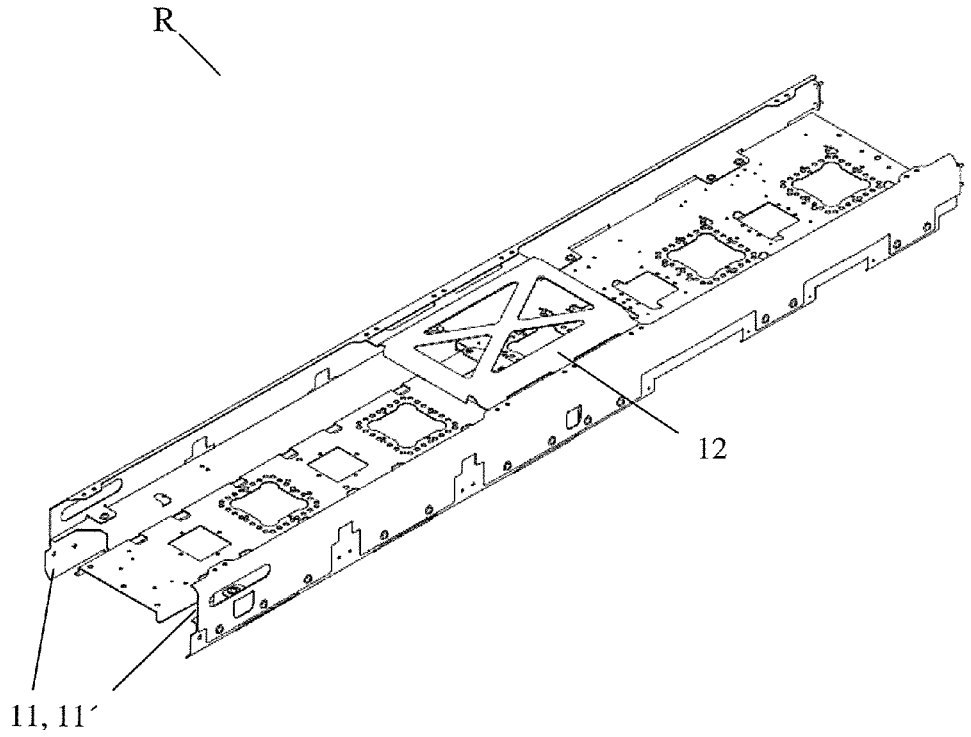
FIG. 13 shows a back side view of the embodiment in FIG. 12.
Figure 14:
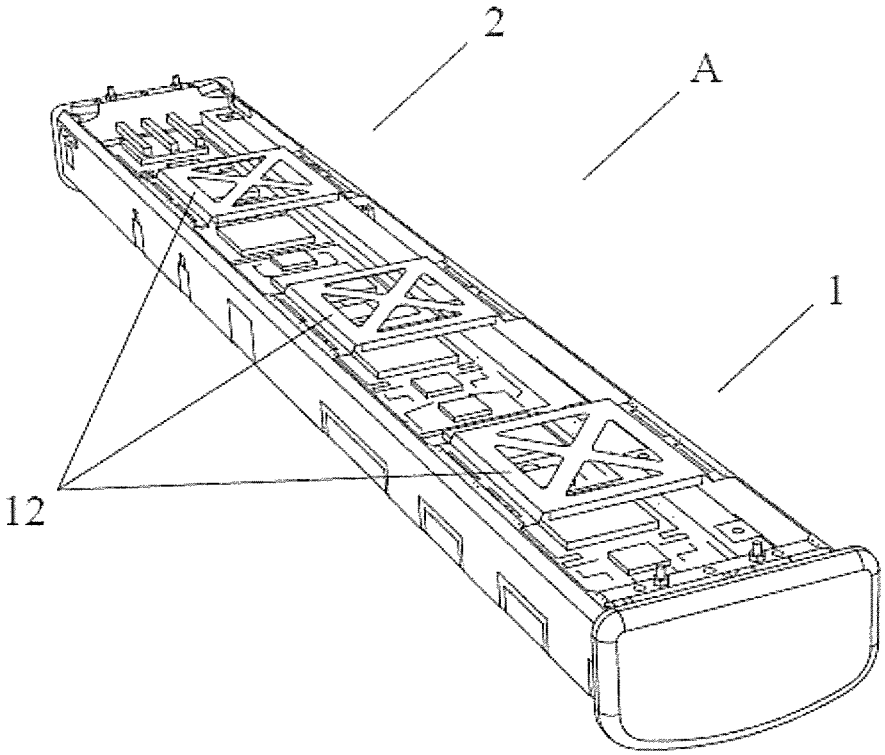
FIG. 14 shows a back side perspective view of an embodiment of a multi band antenna according to the present invention.

A rectangular connecting element 12 with a cross is shown in FIGS. 13 and 14. The cross shape improves the mechanical robustness of the reflector. The connecting element 12 has also four recesses to form the cross thereby reducing the over all weight of the reflector but still provide a robust construction.

It should also be noted that the first 1 and second 2 reflector assemblies according to yet another embodiment comprises at least one pair of symmetrically arranged partially enclosed cavities functioning as current traps 31, 31' for trapping surface currents on the reflector as shown in FIG. 9. In this respect, the cavities should be adapted to a quarter of the wave length of the frequency in use. The partially enclosed cavities preferably extend along the extension of the first 1 and second 2 reflector assemblies in a suitable manner.

The present invention further relates to a multi band antenna comprising at least one antenna array arrangement and at least one reflector R described above. FIG. 14 shows a triple band base station antenna A for wireless communication systems according to the invention. In this multi band antenna, the first type of dual band elements 101 and single band elements 102 are associated with said at least one second reflector assembly 2, and the second type of dual band elements 103 and second type single band elements 104 are associated with the first reflector assembly 1, which means that the associated reflector assembly 1, 2 is the main reflector structure for shaping the radiation of a specific antenna element and is preferably arranged behind the specific antenna element.

Those skilled in the art will also recognize that the described antenna array arrangement will not be dependent on the polarization of the antenna elements but will work for antennas with e.g. vertical polarization, circular polarization or dual +/−45 deg polarization.

Finally, it should be understood that the present invention is not limited to the embodiments described above, but also relates to and incorporates all embodiments within the scope of the appended independent claims.

What is claimed is:

1. An antenna array arrangement for a multi band antenna, comprising:

a plurality of first dual band antenna elements adapted for transmitting or receiving in a lower antenna frequency band and in a higher antenna frequency band, a plurality of first single band antenna elements adapted for transmitting or receiving in said higher antenna frequency band, said first dual band antenna elements and said first single band antenna elements being arranged in a row, wherein at least two first single band antenna elements are arranged adjacent to each other, a plurality of second dual band antenna elements adapted for transmitting or receiving in said lower antenna frequency band and in an intermediate antenna frequency band, and a plurality of second single band antenna elements adapted for transmitting or receiving in said intermediate antenna frequency band.

2. An antenna array arrangement according to claim 1, wherein said at least two first single band antenna elements are arranged between two first dual band antenna elements.

3. An antenna array arrangement according to claim 1, wherein a distance $d_2$ between the centers of said at least two first single band antenna elements is more than half the wavelength for the center frequency of said higher antenna frequency band, and preferably between 0.6-0.9 times the wavelength for the center frequency of said higher antenna frequency band.

4. An antenna array arrangement according to claim 3, wherein the distance $d_2$ between the centers of said at least two first single band antenna elements is 0.6-0.8 times the wavelength for the center frequency of said higher antenna frequency band and the distance between said first dual band antenna elements and said first single band antenna elements is 0.8-1.0 times the wavelength for the center frequency of said higher antenna frequency band.

5. An antenna array arrangement according to claim 1, wherein a distance $d_1$ between the centers of at least two first dual band antenna elements is more than half the wavelength for the center frequency of said lower frequency band.

6. An antenna array arrangement according to claim 1, wherein a center frequency for said higher antenna band frequency is more than 2 times higher than a center frequency for said lower antenna band frequency.

7. An antenna array arrangement according to claim 6, wherein said lower and said higher antenna frequency bands do not overlap, and wherein said center frequency for said lower and higher antenna frequency bands are within the interval of:

790 to 960 MHz and 2.3 to 2.7 GHz;

698 to 894 MHz and 2.3 to 2.7 GHz;

698 to 894 MHz and 3.6 to 3.8 GHz; or 790 to 960 MHz and 3.6 to 3.8 GHz respectively.

8. An antenna array arrangement according to claim 1, wherein said second dual band antenna elements and said second single band antenna elements are arranged in a row.

9. An antenna array arrangement according to claim 1, wherein said second dual band antenna elements and said second single band antenna elements are alternately arranged.

10. An antenna array arrangement according to claim 1, wherein said intermediate antenna frequency band does not overlap with said lower and higher frequency bands; and wherein the center frequency for said intermediate antenna frequency band is within the interval of 1710 to 2170 MHz.

11. An antenna array arrangement according to claim 1, wherein said antenna elements are patch antenna elements or dipoles.

12. A multi band antenna comprising at least one antenna array arrangement, the antenna array arrangement comprising:

a plurality of first dual band antenna elements adapted for transmitting or receiving in a lower antenna frequency band and in a higher antenna frequency band, a plurality of first single band antenna elements adapted for transmitting or receiving in said higher antenna frequency band, said first dual band antenna elements and said first single band antenna elements being arranged in a row, wherein at least two first single band antenna elements are arranged adjacent to each other, a plurality of second dual band antenna elements adapted for transmitting or receiving in said lower antenna frequency band and in an intermediate antenna frequency bands, and a plurality of second single band antenna elements adapted for transmitting or receiving in said intermediate antenna frequency band.

13. A multi band antenna according to claim 12, further comprising a reflector, said reflector comprising a first reflector assembly and at least one second reflector assembly, said first reflector assembly having a first reflector structure adapted for said lower and intermediate antenna frequency bands;

said at least one second reflector assembly having a second reflector structure adapted for said lower and higher antenna frequency bands; and wherein said first reflector assembly and said at least one second reflector assembly are electrically coupled so that said first reflector assembly and said at least one second reflector assembly together form a common reflector structure adapted for said lower, intermediate and higher antenna frequency bands.

14. A multi band antenna according to claim 13, wherein said first reflector assembly and said at least one second reflector assembly further are mechanically connected to each other.

15. A multi band antenna according to claim 14, wherein said first reflector assembly and said at least one second reflector assembly are electrically and mechanically connected by means of a pair of support brackets.

16. A multi band antenna according to claim 15, wherein said first reflector assembly and said at least one second reflector assembly has an elongated shape, and said pair of support brackets are connected to and extend along each opposite side of said first reflector assembly and said at least one second reflector assembly, respectively.

17. A multi band antenna according to claim 14, wherein said first reflector assembly and said at least one second reflector assembly has substantially the same width.

18. A multi band antenna according to claim 14, wherein said first reflector assembly and said at least one second reflector assembly are substantially U-shaped in cross-section.

19. A multi band antenna according to claim 15, wherein said pair of support brackets are L-shaped.

20. A multi band antenna according to claim 14, further comprising at least one connecting element for electrically and mechanically connecting said pair of support brackets so as to improve mechanical stiffness of said common reflector structure.

21. A multi band antenna according to claim 20, wherein said at least one connecting element is arranged on a backside of said common reflector structure and mechanically connects said pair of support brackets.

22. A multi band antenna according to claim 20, wherein said at least one connecting element is cross-shaped and comprises one or more recesses.

23. A multi band antenna according to claim 14, wherein said first reflector assembly and said at least one second reflector assembly are electrically and mechanically connected by means of at least one connector plate arranged on either or both of a backside and a front side of said common reflector structure.

24. A multi band antenna according to claim 13, wherein said first reflector assembly and said at least one second reflector assembly each comprises at least one pair of symmetrically arranged current traps.

25. A multi band antenna according to claim 13, wherein:

said first reflector assembly comprises at least one first pair of reflector elements arranged so as to control the beam pattern of said at least one intermediate antenna frequency band; and said at least one second reflector assembly comprises at least one second pair of reflector elements arranged so as to control the beam pattern of said at least one higher antenna frequency band.

26. A multi band antenna according to claim 13, wherein said first reflector assembly and said at least one second reflector assembly have different shapes.

27. A multi band antenna according to claim 13, wherein:

said first dual band elements and said first single band elements are associated with said at least one second reflector assembly; and said second dual band elements and said second single band elements are associated with said first reflector assembly.

* * * * *

UNITED STATES PATENT AND TRADEMARK OFFICE

CERTIFICATE OF CORRECTION

PATENT NO. : 9,030,367 B2
APPLICATION NO. : 13/454984
DATED : May 12, 2015
INVENTOR(S) : Arvidsson et al.

It is certified that error appears in the above-identified patent and that said Letters Patent is hereby corrected as shown below:

In the Claims:

In column 9, line 4, in Claim 9, delete "claim 1," and insert --claim 8,--, therefor In column 9, line 32, in Claim 12, delete "bands," and insert --band,--, therefor Signed and Sealed this
Second Day of August, 2016

Michelle K. Lee

Michelle K. Lee
*Director of the United States Patent and Trademark Office*